US005695528A

United States Patent [19]

Komori et al.

[11] Patent Number: 5,695,528

[45] Date of Patent: Dec. 9, 1997

[54] TREATING AGENT FOR CELLULOSIC TEXTILE MATERIAL AND PROCESS FOR TREATING CELLULOSIC TEXTILE MATERIAL

[75] Inventors: Katsuhiko Komori, Kanagawa; Akira Saito; Seiji Shimura, both of Tokyo, all of Japan

[73] Assignees: Nippon Chemical Industrial Co., Ltd., Tokyo; Koizumi Chemical Co., Ltd., Kanagawa; Chiyoda Shoji Co., Ltd., Tokyo, all of Japan

[21] Appl. No.: 659,765

[22] Filed: Jun. 6, 1996

[51] Int. Cl.[6] ..... D06M 13/00

[52] U.S. Cl. ..... 8/127.1; 8/120; 8/116.1; 8/181; 252/8.61; 252/8.91; 252/8.86

[58] Field of Search ..... 8/120, 127.1, 116.1, 8/181, 111; 252/8.91, 8.86, 8.61, 8.62, 8.63

[56] References Cited

U.S. PATENT DOCUMENTS 4,154,890 5/1979 Wagner ..... 8/127.1

5,147,409 9/1992 Shimura et al. ..... 8/128.1

FOREIGN PATENT DOCUMENTS 7-145561 6/1995 Japan .

WO89/12714 12/1989 WIPO .

*Primary Examiner*—Alan Diamond

*Attorney, Agent, or Firm*—Sughrue,Mion,Zinn,Macpeak & Seas, PLLC

[57] ABSTRACT

A treating agent for cellulosic textile materials includes a water-soluble phosphonium salt of phosphorus-containing oxoacid and polycarboxylic acid as active ingredients, and a process of treating cellulosic textile materials uses the treating agent. The treating agent eliminates the necessity of the use of a substance releasing formaldehyde during wash and wear treatment and enables non-formaldehyde wash and wear treatment, and the cellulosic textile material treated by the treating agent is completely free from formaldehyde, retains enough of the strength thereof, and undergoes neither discoloration nor fibrillation.

5 Claims, 5 Drawing Sheets

TREATING AGENT FOR CELLULOSIC TEXTILE MATERIAL AND PROCESS FOR TREATING CELLULOSIC TEXTILE MATERIAL

FIELD OF THE INVENTION

The present invention relates to a treating agent for cellulosic textile materials and a process for treating a cellulosic textile material.

BACKGROUND OF THE INVENTION

Textile materials have conventionally been subjected to the shape fixation processing called set or setting for the purposes of shape stability, e.g., shrink proofing and wrinkle resistance, selvadge curl prevention, shape retention, crease recovery, hardening finish, resiliency improvement, and handling touch improvement, regardless of the materials of the fibers. (*Senshoku Kogyo* (Dyeing Industry), 41, pp. 195–214, 1993)

Wash-and-wear (hereinafter referred to as w/w) treatment for improving shape stability such as shrink proofing and wrinkle resistance should be conducted so that bonds present inside the individual fibers are effectively destroyed and reconstituted. Methods used for this treatment include a chemical method and a thermal method.

The chemical method is to use a chemical to destroy and reconstitute bonds present inside the fibers. Examples thereof include mercerization of cotton, phenol treatment of polyesters, and setting of wool by cleavage and reconstitution of disulfide bonds. The thermal method is to use heating to destroy and reconstitute bonds present inside the fibers, and this method is used for the finishing of synthetic fibers such as polyester and nylon fibers.

For the w/w treatment of cellulosic textiles, resin finish is frequently employed so far. Resin finish is achieved mostly by a mechanism in which a resin is fixed to noncrystalline parts of cellulosic fibers or bonded thereto by means of crosslinking. Examples thereof include a condensation type chemical method and a cellulose reaction type chemical method.

The condensation type chemical method, which is a traditional resin finish technique in which a urea-formaldehyde resin, a melamine resin, or the like is used, has a drawback that formaldehyde, which is a carcinogen, generates in a large quantity during the finishing operation and from the finished cellulosic textile material. Because of this, regulations were proposed by WHO, etc., and the resins receiving attention have shifted from high-formaldehyde resins to low-formaldehyde resins such as a dimethyloldihydroxyethyleneurea resin and a glyoxal resin.

The low-formaldehyde resins are merely reduced in formaldehyde generation, and are not completely free from formaldehyde generation. As the carcinogenicity of formaldehyde has become known, investigations on non-formaldehyde type w/w treatment have progressed.

On the other hand, with respect to the cellulose reaction type method, investigations on non-formaldehyde w/w treatment based on a method of polymerization and crosslinking to cellulose have been made for a long time in the United States. Examples thereof include the completely non-formaldehyde type w/w treatment method in which polycarboxylic acid is polymerized to crosslink cellulose, and which has been investigated mainly by Southern Regional Research Center, U.S. Department of Agriculture (hereinafter abbreviated as SRRC).

The use of polycarboxylic acid for crosslinking cellulose began with the method of esterifying and crosslinking cellulose with polycarboxylic acid without using an esterification catalyst which method was published in *American Dyestuff Reporters*, 52, pp. 300–303 (1963). Thereafter, a method for esterification and crosslinking with succinic acid or the like in a solvent was published in *Textile Research Journal*, 34, pp. 331–336 (1964), and a method of using a malonic acid was published in *Textile Research Journal*, 35, pp. 260–270 (1965). Further, the effectiveness of polycarboxylic acid in polymerization and crosslinking to cellulose was reported by SRRC in *Textile Research Journal*, 37, pp. 933–941 (1967) and *Textile Research Journal*, 38, pp. 634–643 (1968).

Furthermore, SRRC reported a method for completely non-formaldehyde type w/w treatment in *Textile Chemist and Colourist*, 21, pp. 13–17 (1989), which method comprises polymerizing polycarboxylic acid and crosslinking cellulose therewith using as a catalyst an alkali metal salt of a phosphorus-containing inorganic acid; regarding this method, applications for patent were filed (WO89/12714 and JP-W-3-503072). (The term "JP-W" as used herein means an "unexamined published International patent application.")

In *Textile Research Journal*, 62, pp. 614–618 (1992) were published methods comprising Using maleic acid and itaconic acid in combination with potassium persulfate as an initiator for polymerization and crosslinking. This method is a non-formaldehyde method in which an alkaline earth metal salt of a phosphorus-containing inorganic acid is used as a catalyst.

The use of a phosphonium salt in cellulosic-textile finishing began with a report in *Canadian Journal of Chemistry*, 41, 821–825 (1963). Such methods relate to the flame proof finish of cellulosic textiles. In many of these methods, the key to the generation of a flame-retardant polymer is reaction with an amine or ammonia. A large number of other flame proof techniques have been patented and put to practical use.

With respect to other applications of a phosphonium salt to cellulosic textiles than flame proof finish, an example thereof was reported in *Textile Research Journal*, 51, pp. 529–537 (1982), in which tetrakis(hydroxymethyl) phosphonium sulfate or tetrakis(hydroxymethyl) phosphonium phosphate was used in place of a persulfate as an initiator for free-radical polymerization in the w/w treatment of cellulosic textiles with N-methylolacrylamide. This prior artificial technique is intended to ensure the effect of w/w treatment by using a phosphonium salt in an extremely small amount within a catalytic-amount range (e.g., 0.93% for the sulfate and 0.49% for the phosphate) in the polymerization of N-methylolacrylamide on fibers to thereby prevent the polymerization inhibition by oxygen dissolved in the water and thus improve the efficiency of polymerization.

In *Textile Research Journal*, 35, pp. 291–298 (1965) was reported a technique of imparting a high degree of wrinkle resistance and moderate flame retardant to a cotton textile by causing the cotton textile to absorb tris(N-methylolcarbamoylethyl)phosphine in an amount of about 10% or more based on the amount of the cotton textile using a combination of zinc nitrate and magnesium chloride as a Lewis acid catalyst and then curing the impregnated textile at 140° to 170° C.

Although the mainstream of the actual w/w treatment of cellulosic textiles has shifted to low-formaldehyde finishing techniques because of the dislike of formaldehyde, which is carcinogenic, it is apparent that non-formaldehyde finishing techniques are more desirable than low-formaldehyde finishing techniques.

Since finishing with a low-formaldehyde resin should be performed in the presence of a Lewis acid catalyst or the like, this finishing causes a decrease in cellulose strength, some cases can reach 50%.

For example, there is a description in JP-W-3-503072, cited hereinabove, concerning the yellowing or discoloration of cellulosic textiles caused by w/w treatment. Specifically, it discloses that yellowing occurs when curing is conducted at 180° C. for 90 seconds.

In the case of the w/w treatment of cellulosic textiles with dimethyloldihydroxyethyleneurea, it is known that a white textile material discolors to assume an off-white color when curing is conducted at 160° C. for 80 seconds.

In this connection, "Conclusion" of *Textile Research Journal*, 62, pp. 614–618 (1992) discloses that cellulosic textiles obtained through the above-described non-formaldehyde type w/w treatment are equal in whiteness to cellulosic textiles obtained through w/w treatment with dimethyloldihydroxyethylene urea.

Some kinds of fibers, e.g., Tencel, develop minute fibrils on the fiber surface as a result of rubbing and wearing when being worn. Since this fibril formation, called fibrillation, is observed as partial discoloration in the case of dyed textiles, some articles may come to have an undesirable appearance.

Although the general purposes of w/w treatment include selvadge curl prevention, shape retention, crease recovery, hardening finish, resiliency improvement, and handling touch improvement besides the shape stability improvement by shrink proofing, wrinkle resistance, etc., the important subjects are to completely eliminate formaldehyde, which is carcinogenic, and to keep the retention of strength after the finishing, and also to avoid discoloration and fibrillation.

SUMMARY OF THE INVENTION

An object of the present invention, which has been achieved in order to accomplish the subjects described above, is to provide a treating agent for cellulosic textile materials which eliminates the necessity of the use of a substance releasing formaldehyde during w/w treatment and enables non-formaldehyde w/w treatment, and with which the cellulosic textile material thus finished is completely free from formaldehyde, retains the intact strength thereof, and undergoes neither discoloration nor fibrillation. Another object of the present invention is to provide a process for treating a cellulosic textile material.

The present invention provides a treating agent for cellulosic textile materials which contains a water-soluble phosphonium salt of phosphorus-containing oxoacid and polycarboxylic acid as active ingredients.

The present invention further provides a process for treating a cellulosic textile material which comprises a first step of immersing the cellulosic textile material in an aqueous solution of the above-described treating agent for cellulosic textile materials, and a second step of subsequently dehydrating the immersed cellulosic textile material and then curing the same by heating.

DETAILED DESCRIPTION OF THE INVENTION

Figure 1:
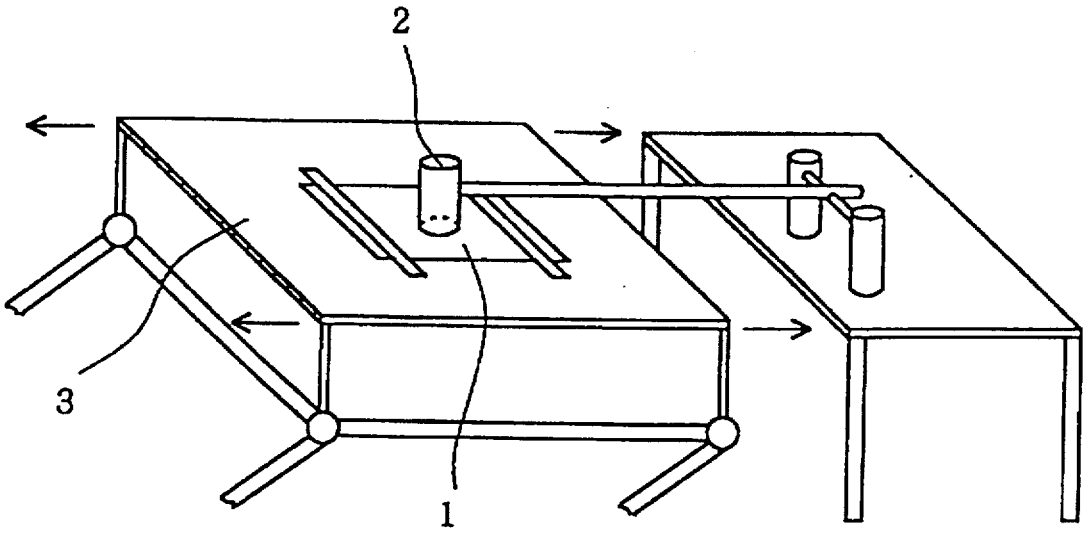
FIG. 1 is a view illustrating a fibrillation test method, in which numeral 1 means a test piece, numeral 2 means a friction element, and numeral 3 means a test piece table.

The treating agent for cellulosic textile materials of the present invention comprises an aqueous solution containing water-soluble phosphonium salt of a phosphorus-containing oxoacid and polycarboxylic acid as active ingredients.

The water-soluble phosphonium salt of phosphorus-containing oxoacid, contained in the treating agent for cellulosic textile materials of the present invention, is preferably a compound represented by general formula (1):

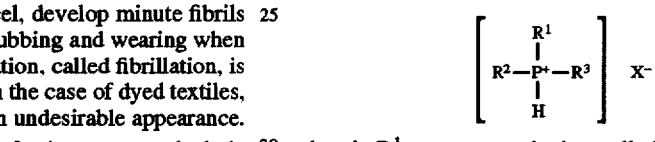

(1)

wherein $R^1$ represents a hydroxyalkyl group having from 2 to 10 carbon atoms, $R^2$ and $R^3$ each represents an alkyl group having from 2 to 10 carbon atoms or a hydroxyalkyl group having from 2 to 10 carbon atoms, and X represents phosphorus-containing oxoacid ion.

In general formula (1), $R^1$ represents a hydroxyalkyl group having from 2 to 10, preferably from 2 to 8 carbon atoms. Examples thereof include hydroxyethyl, hydroxypropyl, hydroxybutyl, hydroxypentyl, hydroxyhexyl, and hydroxyoctyl.

$R^2$ and $R^3$ each represents an alkyl or hydroxyalkyl group having from 2 to 10, preferably from 2 to 8 carbon atoms. Examples of the alkyl group include ethyl, propyl, butyl, pentyl, hexyl, and octyl, and examples of the hydroxyalkyl group include hydroxyethyl, hydroxypropyl, hydroxybutyl, hydroxypentyl, hydroxyhexyl, and hydroxyoctyl.

In general formula (1), $X^-$ represents phosphorus-containing oxoacid ion. Examples thereof include a hypophosphite ion, phosphite ion, orthophosphate ion, pyrophosphate ion, polyphosphate ion, hydroxyethylidenediphosphonate ion, aminotrismethylenephosphonate ion, and ethylenediaminetetramethylenephosphonate ion.

The compound represented by general formula (1) is obtained by reacting a hydroxyalkylphosphine represented by formula (2):

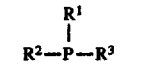

(2)

(wherein $R^1$, $R^2$, and $R^3$ have the same as defined above) with phosphorus-containing oxoacid. It is similar to an ammonium salt obtained by the reaction of ammonia with the phosphorus-containing oxoacid.

In place of the hydroxyalkylphosphine represented by formula (2), a derivative thereof may be used, if desired. Specifically, an adduct thereof with an alkylene oxide such as ethylene oxide or propylene oxide may be used (the number of moles of the added alkylene oxide is from 1 to 5). Consequently, examples of the water-soluble phosphonium salt of phosphorus-containing oxoacid, in the present invention, can include alkylene adducts besides the phosphonium salts enumerated above.

The hydroxyalkylphosphine represented by formula (2) for use in the reaction for producing the compound represented by general formula (1) is especially preferably tris (hydroxyethyl)phosphine, tris(hydroxypropyl)phosphine, tris(hydroxybutyl)phosphine, or the like.

Although the compound represented by general formula (1) is a product of the reaction of acid with base as described above, it need not be normal salt, which satisfies the acid/base stoichiometric relationship. The compound represented by general formula (1) may be a weakly basic or weakly acid salt in which the phosphonium ion or/and the hydroxyalkylphosphine represented by formula (2) are in a small excess or the oxoacid ion is in a small excess.

Preferred examples of the water-soluble phosphonium salt of phosphorus-containing oxoacid represented by general formula (1) include tris(hydroxypropyl)phosphonium phosphinate, tris(hydroxybutyl)phosphonium phosphinate, tris(hydroxyethyl)phosphonium propyl acid phosphate, and tris(hydroxyethyl)phosphonium phosphite.

The polycarboxylic acid contained in the treating agent for cellulosic textile materials of the present invention is an acid containing two or more carboxyl groups. Examples of dicarboxylic acids include malonic acid, itaconic acid, succinic acid, adipic acid, maleic acid, phthalic acid, isophthalic acid, and terephthalic acid. Examples of tricarboxylic acids include 1,2,3-propanetricarboxylic acid, citric acid, aconitic acid, nitrilotriacetic acid, 1,2,3-benzenetricarboxylic acid, and trimellitic acid. Examples of tetracarboxylic acids include 1,2,3,4-butanetetracarboxylic acid, ethylenediaminetetraacetic acid, 1,2,3,4-cyclopentanetetracarboxylic acid, pyromellitic acid, 3,3',3,4'-benzophenonetetracarboxylic acid, and 1,4,5,8-naphthalenetetracarboxylic acid. Examples of hexacarboxylic acids include mellitic acid. These polycarboxylic acids may be used either alone or in combination of two or more thereof.

The concentration of the polycarboxylic acid in a finishing solution according to the treating agent for cellulosic textile materials of the present invention is determined by the degree of various functions which the textile material is required to have after finishing, e.g., shrink proofing, wrinkle resistance, abrasion resistance, fibrillation resistance, resiliency, and strength. The amount of the polycarboxylic acid to be added on the textile material is generally from 1 to 25% by weight, preferably from 3 to 15% by weight, based on the weight of the textile material to be treated.

On the other hand, the concentration of the water-soluble phosphonium salt of a phosphorus-containing oxoacid in the aqueous treating solution is determined by the degree of various functions which the textile material is required to have after finishing. The amount of the water-soluble phosphonium salt of a phosphorus-containing oxoacid to be added on the textile material is generally from 1 to 25% by weight, preferably from 3 to 13% by weight, based on the amount of the textile material to be treated. The amount outside the range is undesirable for the following reasons. If the amount is lower than 1% by weight, the effect of polymerization and crosslinking is liable to be insufficient, and if it exceeds 25% by weight, a poor handling touch, considerable discoloration, and an increased cost may be caused.

Auxiliaries may be added to the finishing solution according to the treating agent for cellulosic textile materials of the present invention, besides the water-soluble phosphonium salt of phosphorus-containing oxoacid and polycarboxylic acid as active ingredients. Usable auxiliaries include a peroxide, e.g., potassium persulfate, as an initiator for accelerating polymerization and crosslinking. A penetrant may also be used for the purpose of enabling the textile material to sufficiently absorb chemicals contained in the treating bath. Preferred examples of the penetrant include a nonionic surfactant. Further, a softener may be added to the treating bath, because cellulosic textile materials having a soft touch are frequently preferred in clothing and other uses. Preferred examples of the softener include a nonionic softener of polyethylene type or silicone type.

Furthermore, a nitrogen-containing compound, e.g., triethanolamine, diethanolamine, monoethanolamine, amine (hydroxymethyl)aminomethane, a hydrochloric acid salt of any of these, a hydroxyalkylamine, or a quaternary ammonium salt, and/or a glycol or a derivative thereof, e.g., glycerol, ethylene glycol, or polyethylene glycol, may be added to the aqueous solution of the treating agent of the present invention for the purpose of improving the dyeability and/or functions of the finished cellulosic textile material.

These auxiliaries, which are selected from peroxides, surfactants, nitrogen-containing compounds, glycols and derivatives thereof, and softeners, may be used alone or in combination of two or more thereof.

The peroxide and softener each can be added preferably from 0.5 to 3% by weight based on the amount of the textile material to be treated, and the nitrogen-containing compound and the glycol or a derivative thereof each can be added generally from 1 to 10% by weight, preferably from 2 to 6% by weight based on the amount of the textile material to be treated. The surfactant can be added generally in a concentration of from 0.5 to 2 g/l in terms of initial concentration in the finishing solution.

The cellulosic textile material to be treated with the treating agent of the present invention is not particularly limited, and may be selected from ordinary cellulosic textile materials. For example, the cellulosic textile material is a textile material containing at least 20% cellulosic fibers consisting of at least one of liquid ammonia-process mercerized cotton, caustic-soda-process mercerized cotton, untreated cotton, liquid ammonia-process mercerized linen, untreated linen, staple fibers, rayons such as cupra, polynosic, and viscose rayon, Tencel, mixed fibers such as polyester/cotton mixed fibers, cotton/rayon mixed fibers, and cotton/linen mixed fibers, and other cellulosic materials.

The form of the cellulosic textile material is not particularly limited. Examples thereof include a woven fabric, knit fabric, nonwoven fabric, fibers, linters, sliver, and paper, but the form of the cellulosic textile material is not limited thereto.

The process for treating a cellulosic textile material with the above-described treating agent of the present invention is then explained below.

The process of the present invention for treating a cellulosic textile material basically comprises: the first step of immersing the cellulosic textile material in an aqueous solution of the treating agent for cellulosic textile materials; and the second step of subsequently dehydrating the immersed cellulosic textile material and curing the same by heating.

Specifically, the process may be carried out, for example, as follows. First, the cellulosic textile material to be treated by the process of the present invention is scoured and desized beforehand, for the purpose of enabling finishing chemicals to be satisfactorily absorbed into the cellulosic fibers. The scouring and desizing may be performed in a conventional manner.

The scoured and desized cellulosic textile material is immersed in a treating agent bath, and then evenly dehydrated by, for example, squeezing with a mangle. If desired and necessary, the immersion and dehydration are repeatedly conducted two or more times in order to sufficiently infiltrate the treating solution into the fibers.

After the treating solution has been sufficiently absorbed into the fibers, the textile material is dehydrated with a squeezer or the like. The degree of squeezing (carryover (wt %), which indicates the amount (wt %) of the treating solution taken up by the fibers and calculated from the weight of the fibers after dehydration and the weight thereof prior to immersion in the treating bath; also called wet pickup (%)) is kept to from 50 to 150% depending on the concentration of the treating bath for the purpose of determining the amount of chemicals adherent to the fibers. The amount of chemicals adherent to the fibers is preferably kept in a reproducible and constant range. The textile material is then dried at 50° to 140° C. to remove the water. If desired, this drying may be omitted.

Subsequently, the textile in which the treating agent has been absorbed in a necessary amount is cured by heating. This heating may be conducted by any of a continuous method, batch method, tumble (batch) method, and the like. However, methods for the heating are not particularly limited thereto.

The temperature and time for curing are determined by the purpose of the finishing. In general, the temperature is from 120° to 240° C., preferably 160° to 200° C., and the time is from 10 to 600 seconds, preferably from 60 to 120 seconds.

In general, the higher the temperature, the shorter the heating time, i.e., the lower the temperature, the longer the heating time. Further, higher temperatures and longer heating times result in a larger chance of discoloration. If desired and necessary, the textile which has undergone curing may be washed with warm or cold water in order to remove the unreacted substances and treating agent from the textile. Thereafter, the textile material is dried to complete the finishing.

The mechanism by which the treating agent of the present invention acts on cellulosic textile materials has not been elucidated. However, in view of the fact that a treated textile obtained by immersing a cellulosic textile in a solution of the treating agent to allow the textile to take up the agent, curing the textile by heating, and then sufficiently washing the same with warm water has a considerably larger weight than the untreated textile (textile which has not undergone the w/w treatment according to the present invention), it is apparent that the treating agent reacts with cellulose. The bonds thus formed are thought to be ester bonds formed by the reaction of hydroxyl groups of the cellulosic fibers with the polycarboxylic acid, and the phosphonium salt is presumed to catalyze the reaction. It is further thought that the phosphonium salt not only functions as a catalyst but also interacts on the polycarboxylic acid to form ester bonds. As a result, cellulosic textiles excellent in abrasion resistance, fibrillation resistance, resiliency, strength, and the like, as well as in the effects of the w/w treatment, e.g., shrink proofing and wrinkle resistance, can be obtained.

The present invention will be explained below in more detail by reference to Examples.

EXAMPLE 1

(1) A treating bath was prepared by dissolving 6.50 wt % tris(hydroxypropyl)phosphonium phosphinate, which is a phosphonium salt represented by the following structural formula, and 6.30 wt % 1,2,3,4-butanetetracarboxylic acid (hereinafter referred to as B.T.C.A.) as active ingredients in warm water along with 1.00 wt % polyethylene type softener (Sumitex Softener L, manufactured by Sumitomo Chemical Co., Ltd., Japan; the same applies hereinafter), the molar ratio of the phosphonium salt to B.T.C.A. being 1/1.14. The temperature of the bath was kept at 35° C.

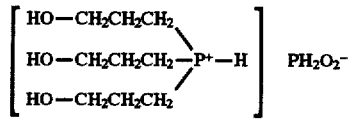

A scoured and desized woven fabric made of 100% staple fibers (100% staple fiber woven fabric for women's blouse (sample No. 1)) and weighing 100 g was immersed as a cellulosic textile sample in 3,000 g of the treating bath for 5 minutes while keeping the temperature of the bath at 35° C. Namely, the bath ratio (weight ratio of treating bath to textile sample) was 30:1. The fabric was then dehydrated with a mangle squeezer to a degree of squeezing of 100% (o.w.f). The same immersion/mangling operation was repeated once for the purpose of attaining homogeneous absorption. The degree of squeezing of 100% means that the textile sample weighed 200 g after dehydration with the mangle squeezer.

The dehydrated cellulosic textile sample was dried at 100° C. for 10 minutes using a thermostatic muffle electric furnace, and then cured at 170° C. for 90 seconds. The cured cellulosic textile sample was washed in a 50° C. water bath for 30 minutes in a bath ratio of 50:1 to remove the unreacted substances and the excess reagents. Thereafter, the sample was dried by standing at room temperature overnight and then further dried at 85° C. for 5 minutes.

(2) A treating bath was prepared by dissolving 3.24 wt % tris(hydroxypropyl)phosphonium phosphate, a phosphonium salt, and 6.30 wt % B.T.C.A. as active ingredients in water along with 1.00 wt % polyethylene type softener, the molar ratio of the phosphonium salt to B.T.C.A. being 1/2. The temperature of the bath was kept at 35° C.

A 100% staple fiber woven fabric for women's blouse (sample No. 1) as a cellulosic textile sample was treated in the same manner as in Example 1-(1), except that the treating bath prepared above was used.

(3) A treating bath was prepared by dissolving 3.69 wt % tris(hydroxypropyl)phosphonium phosphinate, a phosphonium salt, and 6.30 wt % B.T.C.A. as active ingredients in water along with 1.00 wt % polyethylene type softener, the molar ratio of the phosphonium salt to B.T.C.A. being 1/2. The temperature of the bath was kept at 35° C.

A 100% staple fiber woven fabric for women's blouse (sample No. 1), a woven fabric for men's white dress shirt made of 100% caustic-soda-process mercerized cotton (sample No. 3), and a woven fabric for men's white dress shirt made of 100% liquid ammonia-process mercerized cotton (sample No. 4) were treated as cellulosic textile samples in the same manner as in Example 1-(1), except that the treating bath prepared above was used.

EXAMPLE 2

(1) A treating bath was prepared by dissolving 6.50 wt % tris(hydroxypropyl)phosphonium phosphinate, a phosphonium salt, and 10.40 wt % citric acid as active ingredients in water along with 1.00 wt % polyethylene type softener, the molar ratio of the phosphonium salt to citric acid being 1/2.1. The temperature of the bath was kept at 35° C.

A 100% staple fiber woven fabric for women's blouse (sample No. 1) and a woven fabric for men's white dress shirt made of polyester/cotton (50/50) mixed fibers (sample No. 5) were treated as cellulosic textile samples in the same manner as in Example 1-(1), except that the treating bath prepared above was used.

(2) A treating bath was prepared by dissolving 5.96 wt % tris(hydroxypropyl)phosphonium phosphinate, a phosphonium salt, and 10.40 wt % citric acid as active ingredients in water along with 1.00 wt % polyethylene type softener, the molar ratio of the phosphonium salt to citric acid being 1/2. The temperature of the bath was kept at 35° C.

A 100% staple fiber woven fabric for women's blouse (sample No. 1) and a 100% viscose rayon woven fabric (sample No. 2) were treated as cellulosic textile samples in the same manner as in Example 1-(1), except that the treating bath prepared above was used.

(3) A treating bath was prepared by dissolving 5.00 wt % tris(hydroxypropyl)phosphonium isopropyl acid phosphate, a phosphonium salt, and 10.40 wt % citric acid as active ingredients in water along with 1.00 wt % polyethylene type softener, the molar ratio of the phosphonium salt to citric acid being 1/1.60 The temperature of the bath was kept at 35° C.

A 100% staple fiber woven fabric for women's blouse (sample No. 1) as a cellulosic textile sample was treated in the same manner as in Example 1-(1), except that the treating bath prepared above was used.

(4) A treating bath was prepared by dissolving 4.00 wt % tris(hydroxypropyl)phosphonium phosphinate, a phosphonium salt, 10.40 wt % citric acid, and 0.61 wt % tris (hydroxypropyl)phosphine as active ingredients in water along with 1.00 wt % polyethylene type softener and 3 wt % triethanolamine, the molar ratio of the phosphonium salt to citric acid to tris(hydroxypropyl)phosphine being 1/3.39/0.2. The temperature of the bath was kept at 35° C.

A 100% staple fiber woven fabric for women's blouse (sample No. 1), a woven fabric for men's white dress shirt made of 100% caustic-soda-process mercerized cotton (sample No. 3), and a woven fabric for men's white dress shirt made of 100% liquid ammonia-process mercerized cotton (sample No. 4) were treated as cellulosic textile samples in the same manner as in Example 1-(1), except that the treating bath prepared above was used.

EXAMPLE 3

A treating bath was prepared by dissolving 9.00 wt % tris(hydroxypropyl)phosphonium phosphinate, a phosphonium salt, 4.93 wt % maleic acid, and 5.52 wt % itaconic acid as active ingredients in warm water along with 1.50 wt % potassium persulfate, 0.10 wt % nonionic penetrant (Dispol 300, manufactured by Ipposha Oil Industries Co., Ltd., Japan), and 1.00 wt % polyethylene type softener, the molar ratio of the phosphonium salt to maleic acid to itaconic acid being 1/1.3/1.3. The temperature of the bath was kept at 35° C.

A 100% staple fiber woven fabric for women's blouse (sample No. 1) as a cellulosic textile material was treated in the same manner as in Example 1-(1), except that the treating bath prepared above was used.

RESULTS OF EVALUATIONS (1) Colorimetry and Whiteness by Hunter

The cellulosic textile samples obtained in Examples 1 and 2 from the 100% staple fiber woven fabric for women's blouse (sample No. 1) were examined with calorimetric color difference meter Type ND-101DP (manufactured by Nippon Denshoku Kogyo Co., Ltd., Japan) for L value, a value, b value, and whiteness by Hunter (W). The results obtained are shown in Table 1.

TABLE 1

| | L Value | a Value | b Value | W Value |
|---|---|---|---|---|
| Example 1-(1) | 87.20 | −0.94 | 1.84 | 87.05 |
| 1-(2) | 87.58 | −0.48 | 1.98 | 87.41 |
| 1-(2) | 87.10 | −0.70 | 1.82 | 86.95 |
| Example 2-(1) | 87.52 | −1.18 | 2.18 | 87.28 |
| 2-(2) | 87.84 | −0.44 | 2.22 | 87.63 |
| 2-(3) | 87.66 | −0.68 | 2.24 | 87.44 |
| 2-(4) | 88.16 | −0.38 | 2.18 | 87.96 |
| Sample untreated by w/w treatment (Sample No. 1) | 87.02 | −0.38 | 2.38 | 86.80 |

Note)
W Value: Whiteness by Hunter. The value of W three-dimensionally shows a color based on the three elements, i.e., lightness, saturation, and hue, with perfect white being 100. The closer the value of W to 100, the closer the color to perfect white.
a Value: The larger the + value of a, the more the color is reddish, while the smaller the + value of a, the less the color is reddish. The larger the − value of a, the more the color is greenish, while the smaller the − value of a, the less the color is greenish.
b Value: The larger the + value of b, the more the color is yellowish, while the smaller the + value of b, the less the color is yellowish. The larger the − value of b, the more the color is bluish, while the smaller the − value of b, the less the color is bluish.
L Value: L value indicates "lightness." The larger the value of L, the more the color is light.

The larger the value of L and the smaller the value of b, the more the color looks white.

As shown in Table 1, the samples obtained in the Examples had larger values of L and W and smaller values of b than the sample untreated by the w/w treatment of the present invention. These results may be attributable to the bleaching and anti-yellowing function of the tris (hydroxypropyl)phosphonium salts used in the Examples. Thus, the effect of the present invention was clearly observed.

(2) Evaluation for w/w Treatment

The cellulosic textile samples obtained in Examples 1 to 3 and the untreated samples were examined for evaluation for w/w treatment in accordance with JIS L-0217, method 103. The results obtained are shown in Table 2.

TABLE 2

| | w/w Rating | | | | |
|---|---|---|---|---|---|
| Textile sample No. | (1) | (2) | (3) | (4) | (5) |
| Example 1-(1) | 3.8 | | | | |
| 1-(2) | 3.6 | | | | |
| 1-(3) | 3.8 | | 3.5 | 3.6 | |
| Example 2-(1) | 3.8 | | | | 3.6 |
| 2-(2) | 3.6 | 3.6 | | | |
| 2-(3) | 3.4 | | | | |
| 2-(4) | 3.8 | | 3.5 | 3.6 | |

TABLE 2-continued

| Textile sample No. | w/w Rating (1) | (2) | (3) | (4) | (5) |
|---|---|---|---|---|---|
| Example 3 | 3.3 | | | | |
| Sample untreated by w/w treatment | 1.8 | 1.5 | 1.5 | 1.5 | 2.5 |

Note) The textile samples given in Table 2 are as follows.
(1) 100% staple fiber woven fabric for women's blouse
(2) 100% viscose rayon woven fabric
(3) woven fabric for men's white dress shirt made of 100% caustic-soda-process mercerized cotton
(4) woven fabric for men's white dress shirt made of 100% ammonia-process mercerized cotton
(5) woven fabric for men's white dress shirt made of polyester/cotton (50/50) mixed fibers (3) Tear Strength Cellulosic textile samples obtained in Examples 1 and 2 and the samples untreated by w/w treatment were examined for tear strength in accordance with JIS L-1096, method D. The results obtained are shown in Table 3.

TABLE 3

| Textile | Tear Strength (1) | | (2) | | (3) | | (4) | | (5) | |
|---|---|---|---|---|---|---|---|---|---|---|
| Sample No. | Warp-wise | Filling-wise | Warp-wise | Filling-wise | Warp-wise | Filling-wise | Warp-wise | Filling-wise | Warp-wise | Filling-wise |
| Example | | | | | | | | | | |
| 1-(1) | 1320 | 980 | | | | | | | | |
| 1-(3) | | | | | 700 | 510 | 880 | 650 | | |
| 2-(1) | 1380 | 1050 | | | | | | | 870 | 530 |
| 2-(2) | | | 1820 | 1740 | | | | | | |
| 2-(4) | 1420 | 1100 | | | 720 | 530 | 960 | 660 | | |
| Sample untreated by w/w treatment | 570 | 480 | 630 | 440 | 600 | 440 | 810 | 550 | 700 | 490 |

Note) Textile samples Nos. (1) to (5) given in Table 3 are the same as in Table 2.

EXAMPLE 4

(1) A treating bath was prepared by dissolving 3.00 wt % tris(hydroxypropyl)phosphonium phosphinate, a phosphonium salt, and 6.30 wt % B.T.C.A. as active ingredients in water along with 1.00 wt % polyethylene type softener, the molar ratio of the phosphonium salt to B.T.C.A. being 1/2.46. The temperature of the bath was kept at 35° C. A cellulosic textile sample was treated in the same manner as in Example 1-(1), except that the treating bath prepared above was used, and that 100 g of a Tencel denim woven fabric which had been dyed with indigo was used as the cellulosic textile sample.

(2) A treating bath was prepared by dissolving 6.48 wt % tris(hydroxypropyl)phosphonium phosphinate, a phosphonium salt, and 6.30 wt % B.T.C.A. as active ingredients in water along with 1.00 wt % polyethylene type softener, the molar ratio of the phosphonium salt to B.T.C.A. being 1/1. The temperature of the bath was kept at 35° C. A cellulosic textile sample (Tencel denim woven fabric) was treated in the same manner as in Example 4-(1), except that the treating bath prepared above was used.

EXAMPLE 5

A treating bath was prepared by dissolving 3.00 wt % tris(hydroxypropyl)phosphonium phosphinate, a phosphonium salt, and 10.40 wt % citric acid as active ingredients in water along with 1.00 wt % polyethylene type softener, the molar ratio of the phosphonium salt to citric acid being 1/4.52. The temperature of the bath was kept at 35° C. A cellulosic textile sample (Tencel denim woven fabric) was treated in the same manner as in Example 4-(1), except that the treating bath prepared above was used.

RESULTS OF EVALUATIONS (1) Add-on after Air Drying (%)

The samples which had undergone curing and natural convection drying and not undergone 5-minute drying at 85° C. were weighed to determine the add-on (%) thereof using the following equation. The results obtained are shown in Table 4.

$$\text{Add-on after air drying (\%)} = \frac{\left(\begin{array}{c}\text{Weight after natural}\\ \text{convection drying}\end{array}\right) - (\text{Initial weight})}{(\text{Initial weight})} \times 100$$

TABLE 4

| | Carboxylic acid used (%) | Results of measurement (%) |
|---|---|---|
| Example 4-(1) | 6.3 | 9.91 |
| 4-(2) | 6.3 | 8.92 |
| Example 5 | 10.4 | 9.94 |

The results given in Table 4 indicate that in each of the cellulosic textile samples obtained in the Examples, the carboxylic acid was polymerized and crosslinked.

(2) Fibrillation

Fibrillation was examined with a friction tester shown in FIG. 1 as follows. A test piece 1 with dimensions of about 16 cm by 8 cm which had been brought into a wet state of about 100% (o.w.f) was fixed to the test piece table 3. A friction element 2 which weighed about 200 g and covered at its tip with a friction cloth (Tencel denim woven fabric) in a wet state of about 100% (o.w.f) was placed on the test piece table 3. Thereafter, the test piece table 3 was moved from side to side in parallel with the floor for 5 minutes at an amplitude of 4 cm and a frequency of about 110 per minute to rub the friction cloth against the test piece 1. After the test, the test piece 1 was dried, and the resulting fibrillation was visually examined and judged based on the criteria shown later.

The samples obtained in Examples 4 and 5 and the untreated sample were subjected to the above-described friction test. The results of the fibrillation judgement are shown in Table 5.

TABLE 5

| | Results of judgement |
|---|---|
| Example 4-(1) | 5 |
| 4-(2) | 5 |
| Example 5 | 4–5 |
| Sample untreated by w/w treatment | 1 |

Criteria: The degree of fibrillation was judged based on the fibrillation of the untreated sample as determined with respect to each of the friction periods shown below.
equal to fibrillation by 20-second or shorter friction: 5
equal to fibrillation by 40-second or shorter friction: 4–5
equal to fibrillation by 60-second or shorter friction: 4
equal to fibrillation by 80-second or shorter friction: 3–4
equal to fibrillation by 100-second or shorter friction: 3
equal to fibrillation by 240-second or shorter friction: 2
equal to fibrillation by 300-second or longer friction: 1

In FIGS. 2 to 5 are shown an infrared absorption spectrum (FT-IR/PAS) of each of the cellulosic textile sample obtained from the woven fabric for men's white dress shirt made of 100% caustic-soda-process mercerized cotton of sample No. 3 in Example 1-(3), that obtained from the 100% viscose rayon woven fabric of sample No. 2 in Example 2-(2), and those textile samples untreated by w/w treatment.

Figure 2:
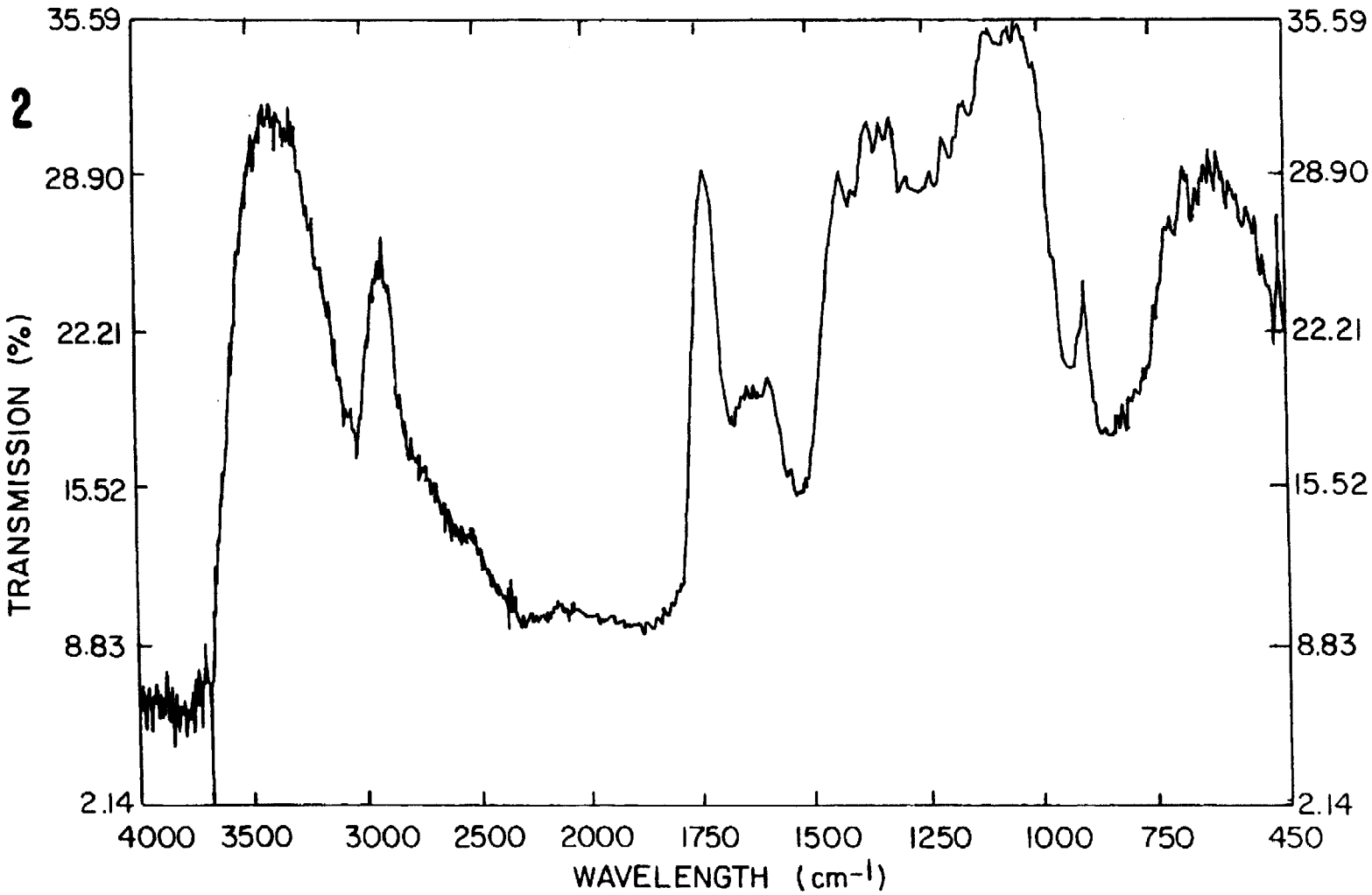
FIG. 2 is an infrared absorption spectrum (FT-IR/PAS) of the cellulosic textile sample obtained from sample No. 3 in Example 1-(3).
Figure 3:
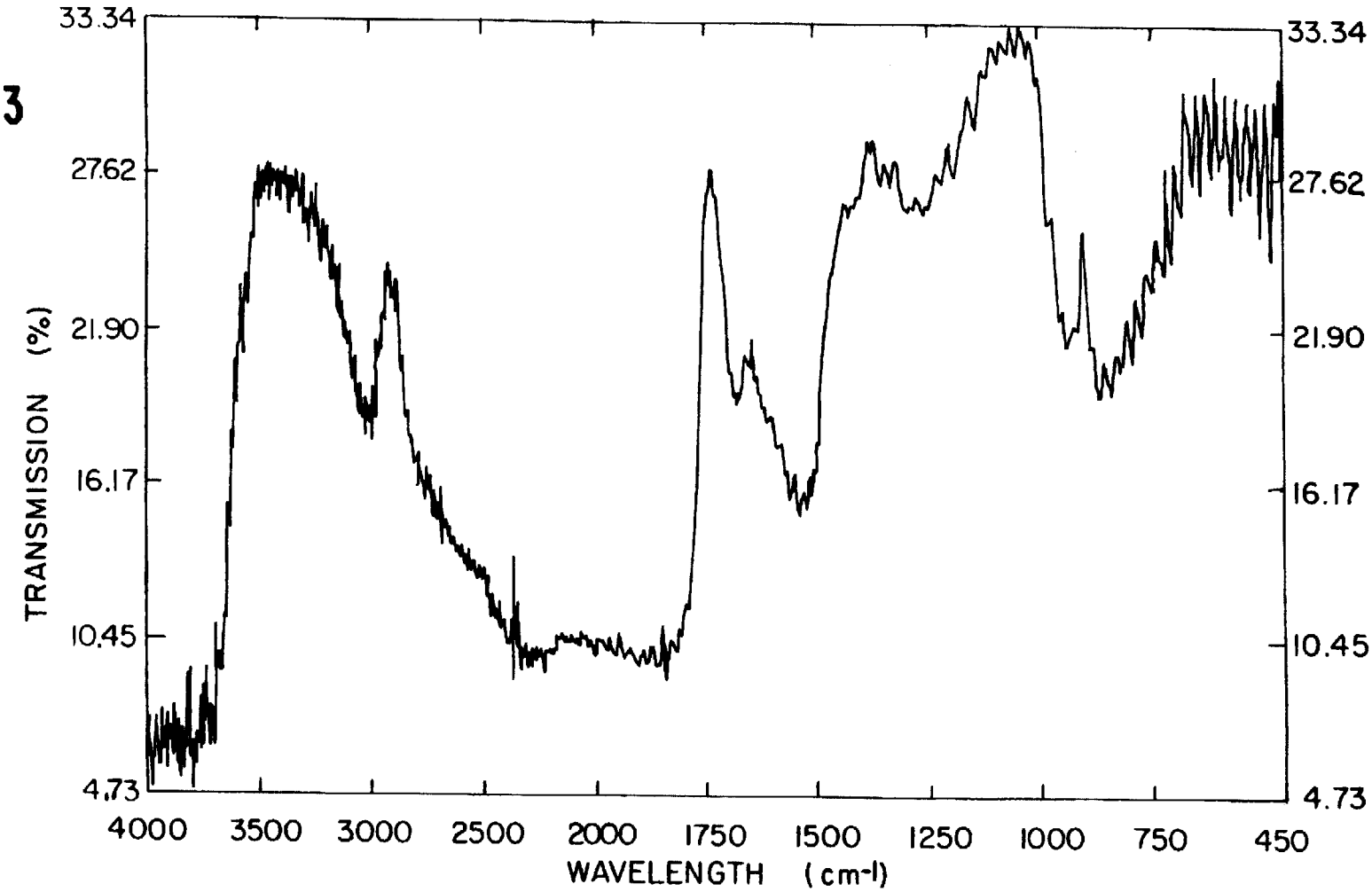
FIG. 3 is an infrared absorption spectrum (FT-IR/PAS) of the cellulosic textile sample obtained from sample No. 2 in Example 2-(2).
Figure 4:
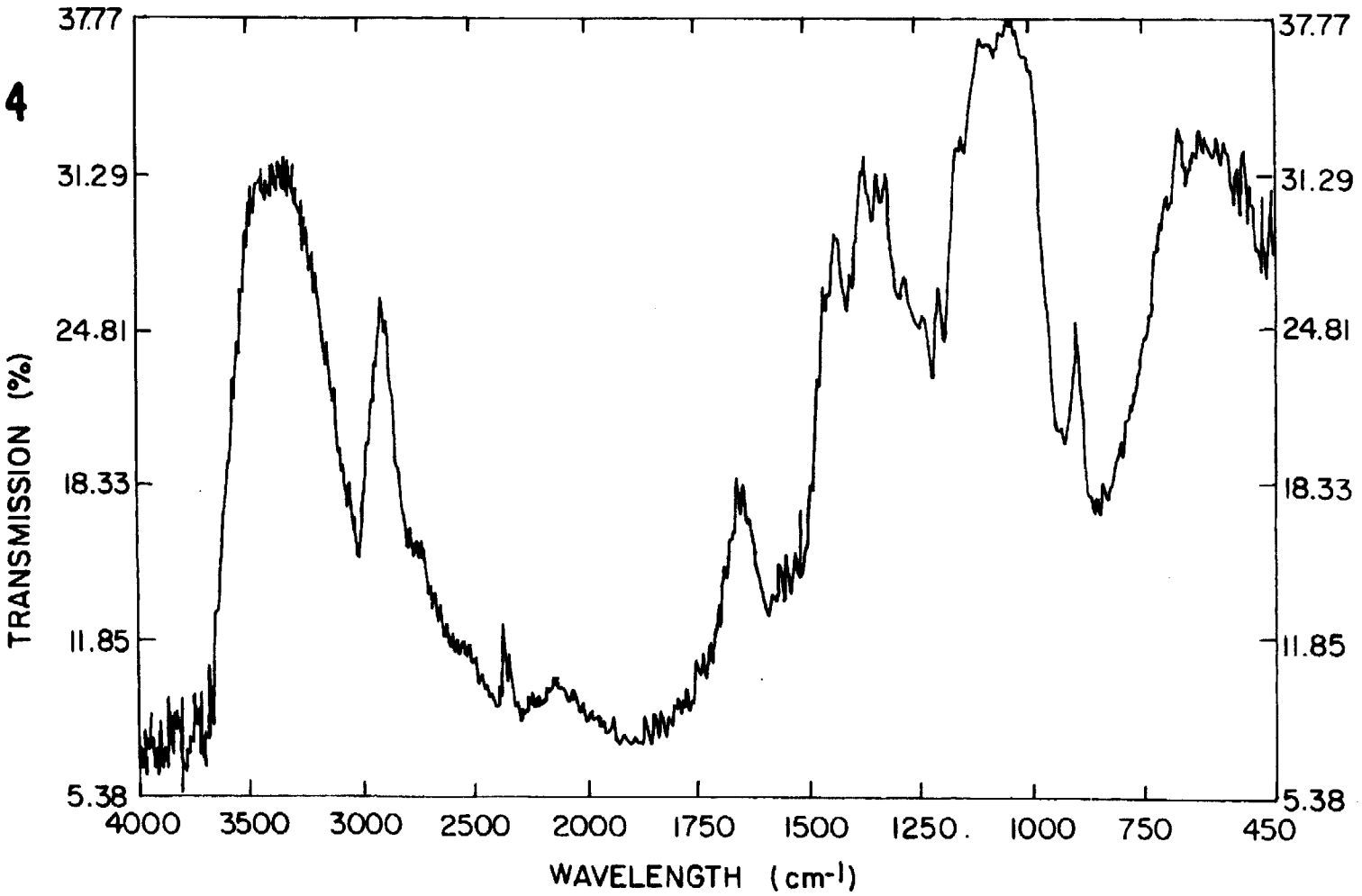
FIG. 4 is an infrared absorption spectrum (FT-IR/PAS) of untreated cellulosic textile sample No. 3 used in Example 1-(3).
Figure 5:
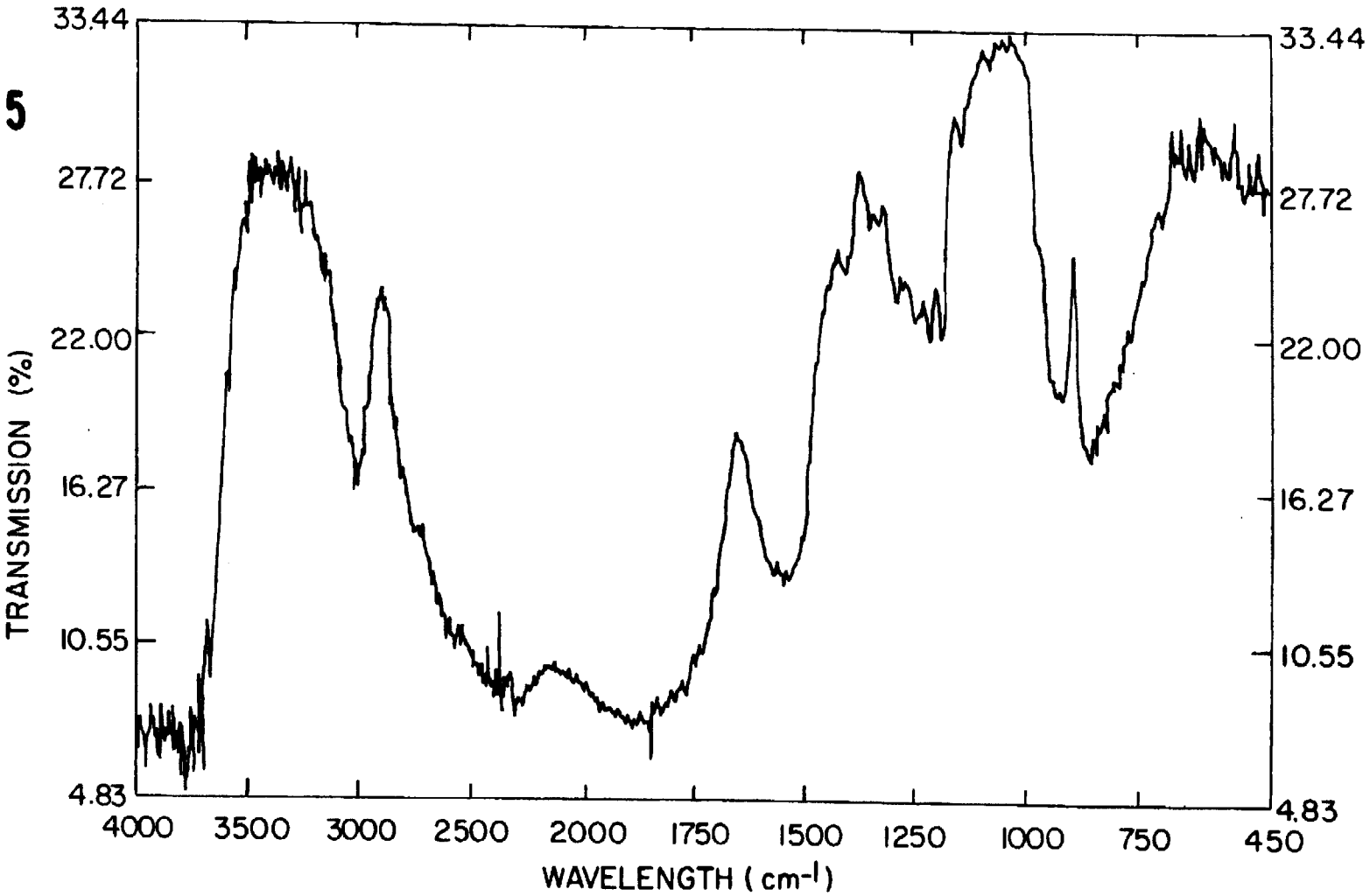
FIG. 5 is an infrared absorption spectrum (FT-IR/PAS) of untreated cellulosic textile sample No. 2 used in Example 2-(2).

FIG. 2 shows an infrared absorption spectrum (FT-IR/PAS) of the cellulosic textile sample obtained from sample No. 3 in Example 1-(3); FIG. 3 shows an infrared absorption spectrum (FT-IR/PAS) of the cellulosic textile sample obtained from sample No. 2 in Example 2-(2); FIG. 4 shows an infrared absorption spectrum (FT-IR/PAS) of untreated cellulosic textile sample No. 3 used in Example 1-(3); and FIG. 5 shows an infrared absorption spectrum (FT-IR/PAS) of untreated cellulosic textile sample No. 2 used in Example 2-(2).

FIGS. 2 and 3 show that cellulosic fibers crosslinked with polycarboxylic acid gave an infrared absorption spectrum (FT-IR/PAS) having an intense absorption peak at 1,725 $cm^{-1}$ assignable to carbonyl groups. In contrast, the spectra of the untreated cellulosic textile samples shown in FIGS. 4 and 5 had no absorption peak at 1,725 $cm^{-1}$. The above results show that according to the treating agent and treatment process of the present invention, carbonyl groups are incorporated into cellulosic fibers, whereby the effects of the present invention can be obtained.

As described above, the treating agent for cellulosic textile materials of the present invention and the process for treatment therewith bring about the following effects. The necessity of the use of a substance releasing formaldehyde during w/w treatment can be eliminated, and non-formaldehyde w/w treatment is possible. The cellulosic textile material thus finished is completely free from formaldehyde, retains the enough strength thereof, and undergoes neither discoloration nor fibrillation, etc.

While the invention has been described in detail and with reference to specific embodiments thereof, it will be apparent to the one skilled in the art that various changes and modifications can be made therein without departing from the spirit and scope thereof.

What is claimed is:

1. A treating agent for cellulosic textile materials which comprises a water-soluble phosphonium salt of a phosphorus-containing oxoacid and a polycarboxylic acid as active ingredients.

2. The treating agent for cellulosic textile materials of claim 1, wherein the water-soluble phosphonium salt of a phosphorus-containing oxoacid is represented by general formula (1):

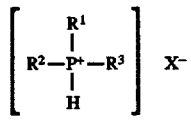

(1)

wherein $R^1$ represents a hydroxyalkyl group having from 2 to 10 carbon atoms, $R^2$ and $R^3$ each represents an alkyl group having from 2 to 10 carbon atoms or a hydroxyalkyl group having from 2 to 10 carbon atoms, and $X^-$ represents a phosphorus-containing oxoacid ion.

3. The treating agent for cellulosic textile materials of claim 1, which further contains one or more auxiliaries selected from the group consisting of a peroxide, a surfactant, a nitrogen-containing compound, a glycol, and a softener.

4. A process for treating a cellulosic textile material which comprises:

the first step of immersing the cellulosic textile material in an aqueous solution of a treating agent comprising a water-soluble phosphonium salt of a phosphorus-containing oxoacid and a polycarboxylic acid as active ingredients, and the second step of subsequently dehydrating the immersed cellulosic textile material and then curing the cellulosic textile material by heating.

5. The process of claim 4, wherein the water-soluble phosphonium salt of a phosphorous-containing oxoacid and the polycarboxylic acid are each present in the treating agent in an amount of from 1 to 25% by weight based on the weight of the cellulosic textile material.

* * * * *